US005775774A

United States Patent [19]

Okano

[11] Patent Number: 5,775,774

[45] Date of Patent: Jul. 7, 1998

[54] TILT MECHANISM FOR CHAIRS

[76] Inventor: Hiroshi Okano, 12 Olive Avenue, Toronto, Ontario, Canada, M6G 1T8

[21] Appl. No.: 689,611

[22] Filed: Aug. 12, 1996

[51] Int. Cl.[6] ..... A47C 3/026

[52] U.S. Cl. ..... 297/300.2; 297/303.1; 297/316

[58] Field of Search ..... 297/300.2, 303.1, 297/298, 316

[56] References Cited

U.S. PATENT DOCUMENTS

| | | | |
|---|---|---|---|
| 3,560,048 | 2/1971 | Flint | 297/389 |
| 4,411,469 | 10/1983 | Drabert | 297/300.2 |
| 4,640,548 | 2/1987 | Desanta | 297/320 |
| 4,709,962 | 12/1987 | Steinmann | 297/316 X |
| 4,765,679 | 8/1988 | Lanuzzi et al. | 297/316 X |
| 4,773,706 | 9/1988 | Hinrichs | 297/316 X |
| 4,789,203 | 12/1988 | Van Zee | 297/316 X |
| 4,804,227 | 2/1989 | Hansen | 297/301 |
| 4,848,837 | 7/1989 | Völke | 297/316 X |
| 4,854,641 | 8/1989 | Reineman et al. | 297/300.2 X |
| 4,889,385 | 12/1989 | Chadwick | 297/303.1 |
| 4,979,778 | 12/1990 | Shields | 297/300.2 |
| 5,035,466 | 7/1991 | Mathews | 297/337 |
| 5,052,753 | 10/1991 | Buchacz | 297/303.1 X |
| 5,249,839 | 10/1993 | Faiks | 297/301 |
| 5,308,144 | 5/1994 | Korn | 297/300.2 |
| 5,348,372 | 9/1994 | Takamatsu et al. | 297/303.1 |
| 5,564,783 | 10/1996 | Elzenbeck et al. | 297/300.2 |

*Primary Examiner*—Peter M. Cuomo
*Assistant Examiner*—Rodney B. White
*Attorney, Agent, or Firm*—Rogers & Scott

[57] ABSTRACT

A support structure is provided for attachment to a chair base to support a seat and a backrest. The structure includes a tilt mechanism operable by leaning on an associated backrest to bend a spring link. As a result, both the backrest and seat tilt a predetermined amount. The disclosure also provides an embodiment in which the tilt mechanism is adjustable so that the user can vary the amount of tilt achieved by leaning on the backrest.

17 Claims, 4 Drawing Sheets

TILT MECHANISM FOR CHAIRS

BACKGROUND OF THE INVENTION

This invention relates to chairs having a structure which responds to the user leaning back to cause some degree of tilting adjustment in the chair, and more particularly to a mechanism for use in chairs to permit the user to lean back and adjust both the backrest and the seat simultaneously. In a preferred embodiment the mechanism is adjustable to vary the resistance to tilting so that for a given load the degree of tilting of the backrest and seat can be changed.

FIELD OF THE INVENTION

This invention will be described with particular reference to office chairs such as those used by persons operating computers at desks. However, it will be appreciated that the description is exemplary only and that the invention can be installed in a variety of chairs.

Office chairs have evolved from simple chairs into sophisticated adjustable structures on casters. The chairs move readily over carpet, can be adjusted for height very simply, and often the back will tilt as the user leans back. The degree of tilt can often be adjusted. Various other adjustments have been used for arms, for the height of the back, etc.

It would be desirable to provide a mechanism for incorporation into a chair to permit the user to tilt both the backrest and the seat simply by leaning back. Preferably resistance to tilting would be adjustable so that the degree of support could be continuously varied between soft to firm.

SUMMARY OF THE INVENTION

Accordingly, in one of its aspects, the invention provides a for attachment to a chair base to support a seat and a backrest. The structure includes a tilt mechanism operable by leaning on an associated backrest to deflect a spring link. As a result, both the backrest and seat tilt a predetermined amount.

The invention also provides an embodiment in which the tilt mechanism is adjustable so that the user can vary the amount of tilt achieved by leaning on the backrest.

BRIEF DESCRIPTION OF THE DRAWINGS

The drawings included in this description are as follows.

DESCRIPTION OF THE PREFERRED EMBODIMENTS

Figure 1:
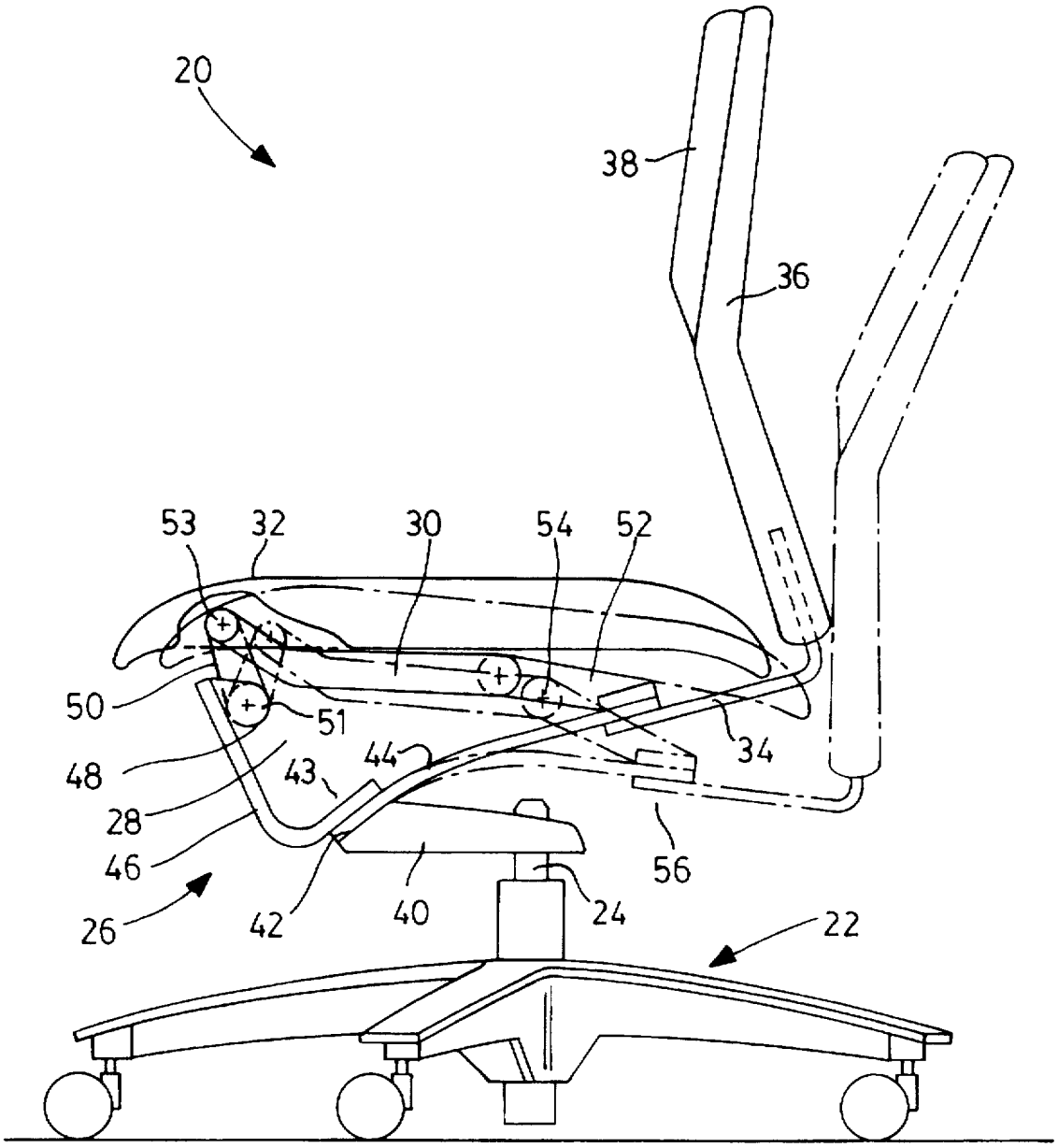
FIG. 1 is a side view, somewhat in diagrammatic form, to illustrate a first embodiment of a chair incorporating a support structure according to the invention, the chair being shown in solid outline in the unloaded or normal position, and in ghost outline in a user actuated or tilted position.

Reference is made firstly to FIG. 1 which illustrates an exemplary chair indicated generally by the numeral 20. The chair includes a conventional swivel base 22 having an upright post 24 carrying a support structure 26 which includes a tilt mechanism indicated generally by the numeral 28. This mechanism has a seat support 30 extending from front to rear and to which a padded seat 32 is attached. At its rear, the mechanism 28 terminates in a backrest support 34 which extends rearwardly and upwardly to support a backrest 36 carrying a forwardly facing padded element 38.

The post 24 extends upwardly from the base 22 and carries a forwardly extending support arm 40 which terminates at an upwardly and rearwardly inclined face 42. This face forms parts of a fixed joint 43 where a spring link 44 is sandwiched between the face 42 and a generally L-shaped rigid front element 46 so that the spring link is fixed at one end relative to the support arm 40 and extends upwardly and rearwardly from this attachment to a rear end.

The rigid front element 46 extends forwardly and apparently then upwardly to a distal end where it is attached to a generally U-shaped (in plan view) bracket 48 carrying the pivot for an upwardly extending swing link 50 which is pivotally connected at a first end to the bracket for rotation about a first horizontal axis 51. The second end of the swing link is pivotally connected to the seat support 30 for rotation about a second axis parallel to the first axis 53. At the other end of the seat support, there is a pivotal connection to an upper end of a connecting link 52 for movement about a third axis which is also parallel to the first axis. The connecting link 52 meets the spring link 44 at a connection 56 where a lower end of link 52 is rigidly attached to a rear end of the spring link 44 with the link sandwiched between the connecting link 52 and the rigid backrest support 34.

In the unloaded or normal position for the chair, which is shown in full outline, the spring link 44 is stressed to provide sufficient upward force on the backrest support 34 to support the backrest 36 and seat 32 in the positions shown. The energy stored in the spring link is normally sufficient to provide adequate support for the user but there could be some deflection when the user sits on the seat depending on the selection of the spring link 44.

To explain the operation of the tilt mechanism 28, it is convenient to assume that when the user sits on the seat 32 there is minimal deflection. However, when the user leans on the padded elements 38 to push the backwards backrest 36, there is a significant bending moment applied to the spring link 44 causing it to deflect joint 43 where it is anchored. And exemplary deflection is shown as a tilted position in ghost outline. As the movement of the backrest takes place from the normal position to the tilted position, the connecting link 52 is drawn downwardly with this movement resulting in the seat support 30 moving downwardly and rearwardly accommodated by the freedom provided by the swing link 50. It will be evident that by selecting the position and length of the swing link, the position of the seat 32 can be predetermined. In the drawings, the tilted position is shown in ghost outline and it will be seen that the seat 32 has moved slightly rearwardly and tilted downwardly at the rear sufficient to limit any tendency for the user to slide forwardly as load is applied to the backrest.

The motion of the tilt mechanism is controlled to a large extent by the load on the backrest 36 so that the user will find that various postures provide different positions for the seat. This gives the user the possibility of changing posture and relaxing as required in a very natural way. When the user sits upright to work at a keyboard or the like, then the chair effectively follows the user providing good posture for working.

The chair shown in FIG. 1 has fixed characteristics once the chair is assembled ready for use using a selected spring link 44. Although these characteristics can be changed by using a different spring link 44, it may be desirable for the characteristics to be adjustable to accommodate different requirements by a user, or by various users. Such adjustment is provided in a second embodiment of the chair illustrated in FIG. 2 and which will be explained with reference to FIGS. 2 to 4.

Figure 2:
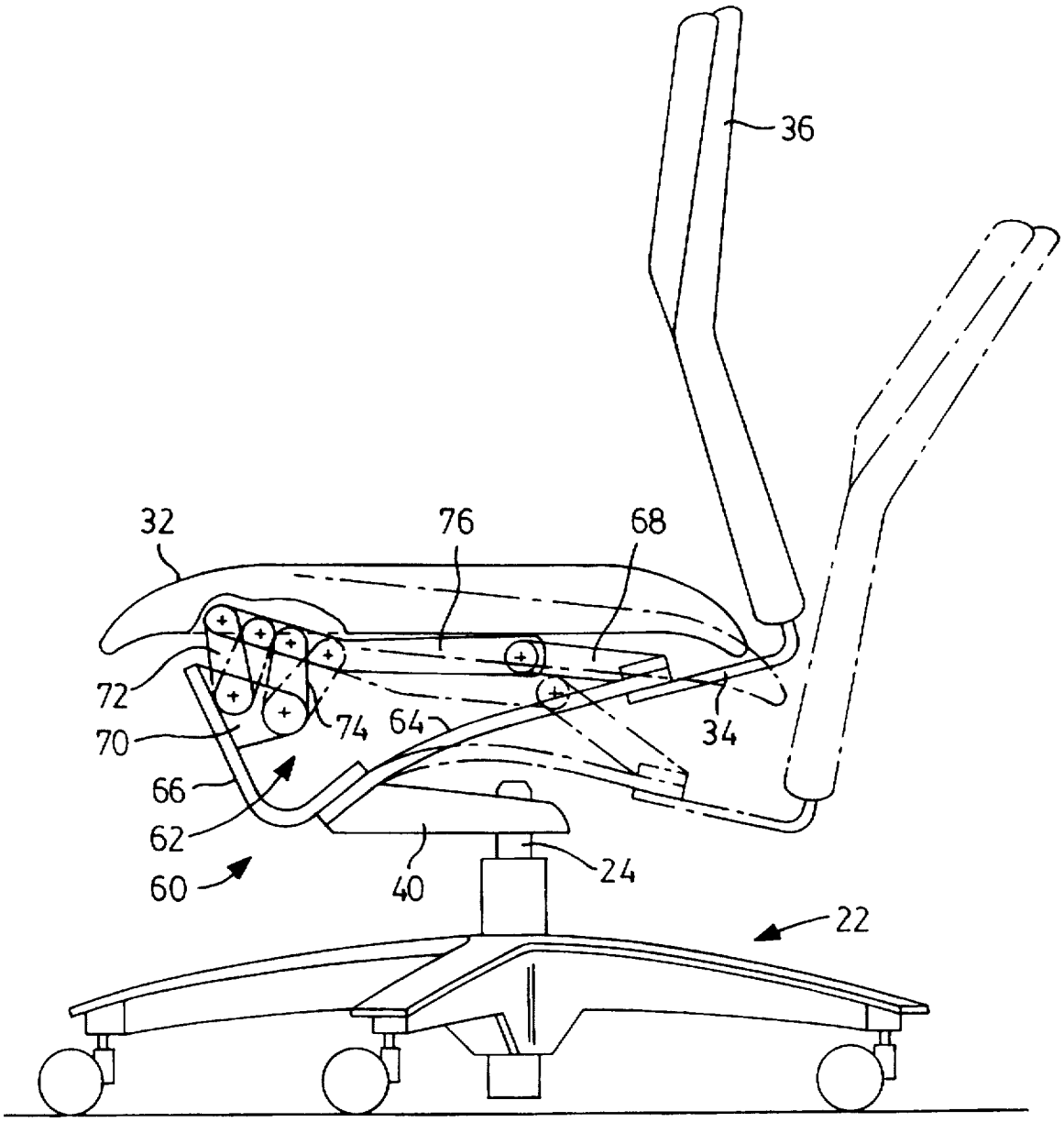
FIG. 2 is a view similar to FIG. 1 and illustrating a second embodiment of support structure which includes an adjustable tilt mechanism.

Reference is next made to FIG. 2 in which parts which are the same as those described with reference to FIG. 1 are given the same numerals as those appearing in FIG. 1. The differences between the chair shown in FIGS. 1 and 2 lie in the support structure. As seen in FIG. 2*a* support structure 60 has an adjustable tilt mechanism 62. However, there are similarities and between the structure 26 (FIG. 1) and structure 60. These parts that are similar will be described briefly first. The support arm 40 is attached to a spring link 64 extending between a rigid front element 66 and a lower end of a connecting link 68. At the front end of the rigid front element 66 is a U-shaped bracket 70 carrying pivots not only for a swing link 72 but also for a control link 74 used in this embodiment. The links extend generally upwardly from the bracket 70 and a seat support 76 extends rearwardly from pivotal connections with upper ends of the swing link 72 and control link 74 terminating at a pivotal connection with the connecting link 68.

The structure shown in FIG. 2 differs from that described with reference to FIG. 1 in that the natural flexibility of the spring link 64 is controlled to adjust the resistance to tilting and thereby provide a different "feel" when the user leans back on the backrest 36. In the position shown in FIG. 2, the relative locations of the swing link 72 and control link 74 are such that the adjustable tilting mechanism is transparent to the user in the sense that the seat will operate in the same fashion as the seat shown in FIG. 1. However, if the position of the control link 74 is adjusted relative to the swing link 72, then the resistance exhibited by the mechanism against change will be different. This will now be explained with reference to FIG. 3 and subsequently, the mechanism itself will be described with reference to FIG. 4.

Figure 3:
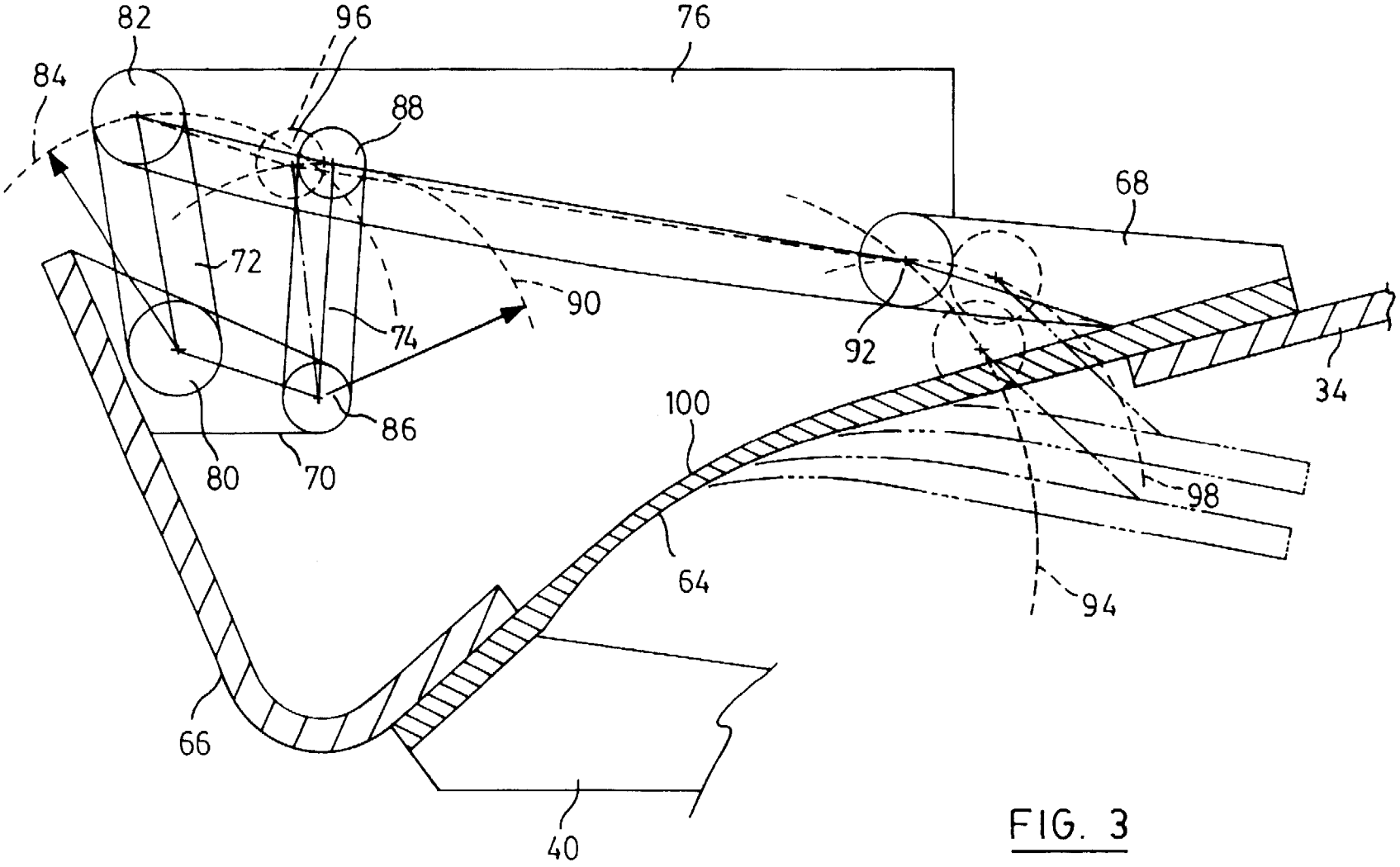
FIG. 3 is a diagrammatic view of the adjustable tilt mechanism shown in FIG. 2 and drawn to a large scale to illustrate the principle of operation of the adjustable tilt mechanism.

Reference is next made to FIG. 3 which is a diagrammatic representation of a side view of the tilt mechanism described with reference to FIG. 2. It will be seen in this diagrammatic representations that the swing link 72 is free to rotate about a pivot point 80 (which in the structure is the first axis corresponding to axis 51 in FIG. 1.) As a result a pivot point 82 at the other end of link 72 will traverse an arc 84. Similarly, the control link 74 is set to rotate about a pivot point 86 so that a pivot point 88 at the other end passes along an arc 90. Consequently, if the condition shown in full outline is considered, when the spring link 64 is deflected by operation of the backrest, the connecting link 68 will follow and pivot around a pivot point 92 relative to the seat support 76. However, the seat support 76 will travel in a path controlled by the swing link 72 and control link 74. For instance, when the link 76 moves to the right of FIG. 3, the pivot points 82 and 88 follow the respective arcs 84, 90 and it will be clear from this that because the pivot point 88 is almost at the top of the arc, then as the motion continues, the pivot point 92 will follow an arc 94. This restriction causes the spring link to flex to accommodate how the arc moves. In the condition shown in full outline, the movement replicates what would be obtained with the FIG. 1 embodiment (given that the links and geometry are selected to give this result).

Now consider a situation in which the link 74 has been rotated anti-clockwise relative to the pivot point 86 into a position shown in ghost outline and indicated by the reference numeral 96. It will be clear that the pivot point 88 has not only moved forwards (to the left of FIG. 3) but has moved downwardly. The structure is designed to accommodate this downward movement during adjustment without affecting the orientation of the seat and backrest. This will be more fully described with reference to FIG. 4.

When the user leans on the backrest, the resulting downward motion of the connecting link 68 is now controlled in a new arc 98. This is because the resulting rearward motion of the seat support 76 results in the pivot points 82 and 88 moving such that the pivot point 92 follows arc 98. Consequently, the spring link 64 has less opportunity to flex in the same position that it flexed previously and tends to flex more towards the backrest support 34. This means that a user, to get tilt, must push harder on the backrest 36 to overcome an increased resistance so that the chair feels stiffer than it did in the previous condition. It should also be noted that the spring link 64 is designed to accommodate these desired conditions. Although it is difficult to show in drawings to this scale, there is a point 100 on the spring link 64 where the spring link is at its thinnest. The actual cross-sectional shape of the spring link would be designed to give the characteristics desired when taken in combination with the relationships of the links. However, in general, the zone of minimum stiffness 100 flexes when minimum resistance is required and as the user demands more resistance to flexing, the zone of bending will move rearwardly as the mechanism is adjusted.

It will be evident from FIG. 3 that a small angular movement of the control link 74 results in a significant change to the flexibility of the structure so that control of this link will give effective control to the seat and to the tilting mechanism as a whole. This will be better understood with reference to the FIG. 4.

Figure 4:
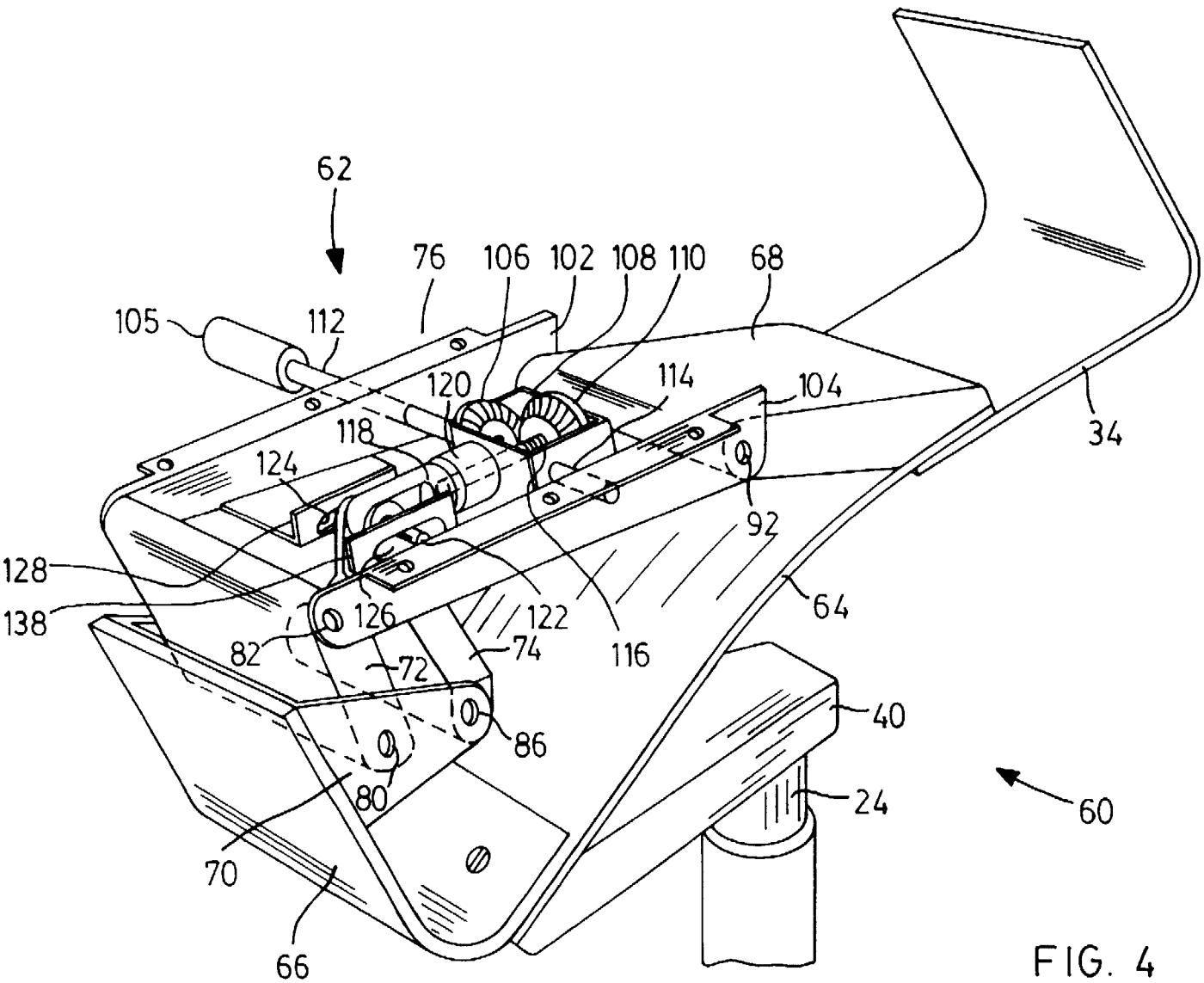
FIG. 4 is an isometric view of the adjustable tilt mechanism as seen in FIG. 3 and shown in association with a support structure.

Reference is next made to FIG. 4 which illustrates parts of the support structure 60 and more particularly the adjustable tilt mechanism 62. It will be seen that the seat support 76 actually consists of first and second elements 102, 104 spaced apart and connected at pivots points or axes 82 and 92 respectively to the swing link 72 and to the connecting link 68. Although, for simplicity, the control link 74 was previously described diagrammatically as being connected to the seat support 76, it will be apparent from FIG. 4 that the connection is via a mechanism controlled by an adjusting knob 105 mounted for rotation in the element 102 to drive a bevel gear 106 mated within a gear box 108 to a right angle bevel gear 110. The gear box 108 is effectively trunnioned between the elements 102,104 by a shaft 112 attached to the knob 105 and an aligned stub axle 114 at the other side of the gear box. The arrangement is such that the gear box is free to tilt about the common axis of the shaft 112 and axle 114.

The bevel gear 110 has a threaded shaft 116 extending forwardly and extends into a threaded bore in a telescopic element 118 journaled in a tubular extension 120 of the gear box 108. As a result, when the bevel gear 110 rotates, the threaded connection to the element 118 causes the element 118 to slide longitudinally relative to the gear box. At the same time which passes transversely through an end of the element 118 is moved within a pair of curved slots 124, 126 in respective upright guides 128, 130 forming part of the seat support 76. The slots 124, 126 are curved to accommodate movement of the pivot point 88 (FIG. 3) along arc 90 without transferring loading on to the seat support 76 as this adjustment takes place.

The pin 122 is attached to the control link 74 so that when the knob 105 is rotated, the element 118 moves longitudinally driven by the action of the gear box and the pin 122 moves in the slots 24, 126 resulting in angular movement of the control link 74 about the pivot point on axis 86.

It should be noted that regardless of the adjustment, all of the flexibility comes from the spring link 64 and that the structure controls how the flexibility is used. Put another way, the resulting forces on the spring link 64 will change as the angular relationships of the swing link 72 and control link 74 are changed.

The spring link 64 is preferably non-metallic and is made from synthetic plastics materials, typically either long glass fibres laid in epoxy resin, or a combination of long glass and carbon fibres laid in an epoxy resin. The spring links are custom made to provide the desired zones of flexibility.

The invention has been described in an exemplary form for an exemplary use. It will be appreciated by those skilled in the art that the invention can take different forms within the scope of the invention as described and claimed.

I claim:

1. A support structure for use in a chair having a seat, a backrest and a base to provide a tilting action, the support structure having:

a front element adapted to be fixed to the base for extending forwardly and upwardly terminating at a distal end;

a spring link adapted to be fixed to the base for extending rearwardly terminating at a rear end for bending to accommodate the tilting action;

a seat support pivotally coupled to said distal end of the front element and coupled to the spring link at said rear end; and a backrest support fixedly attached to said rear end of the spring link whereby on assembly, a force applied to the backrest support will bend the spring link and result in said tilting action.

2. A support structure as claimed in claim 1 and further having:

a control link pivotally connected to said front element and extending upwardly with a selected angular orientation relative to the swing link, the control link having an upper end;

an adjuster coupled to the seat support and to said upper end of the control link and operable to change the angular orientation of the control link in relation to the swing link to thereby change the resistance to the tilting action.

3. A support structure as claimed in claim 2 in which the spring link is non-metallic.

4. A support structure as claimed in claim 1 in which the spring link has a zone of reduced thickness to provide maximum flexibility in this zone.

5. A support structure as claimed in claim 4 in which the spring link is non-metallic.

6. A support structure as claimed in claim 1 in which the spring link includes fibreglass and epoxy resin.

7. A support structure as claimed in claim 1 in which the spring link is non-metallic.

8. A support structure for a seat to provide a tilting action when the user leans back in the seat, the structure having:

a support arm for attachment to a seat base;

a bracket fixedly attached to the arm and extending upwardly from the arm;

a spring link fixedly attached to the arm and extending rearwardly for bending to accommodate the tilting action;

a swing link extending upwardly from the bracket and coupled to the bracket for pivotal movement about a longitudinal first axis;

a seat support having front and rear ends pivotally coupled to the swing link at said front end about a second axis parallel to said first axis and above the first axis;

a connecting link fixed to the spring link remote from the support arm and pivotally connected to said rear end of the seat support about a third axis parallel to said first axis;

a backrest support fixedly connected to the spring link; and whereby rearward load applied to the backrest support will bend the spring link downwardly relative to the support arm and the connecting link will follow the spring link thereby tilting the seat support rearwardly as the swing link accommodates the motion.

9. A support structure as claimed in claim 8 and further having:

a control link pivotally connected to said bracket and extending upwardly with a selected angular orientation relative to the swing link , the control link having an upper end;

an adjuster coupled to the seat support and to said upper end of the control link and operable to change the angular orientation of the control link in relation to the swing link to thereby change the resistance to tilting action.

10. A support structure as claimed in claim 8 in which the spring link has a zone of reduced thickness to provide maximum flexibility in this zone.

11. A support structure as claimed in claim 8 in which the spring link is non-metallic.

12. A chair having a tilting action, the chair including:

a base;

a support structure coupled to the base and including a tilt mechanism having a spring link fixed at a forward end and extending rearwardly for bending to accommodate the tilting action, a seat support having front and rear ends, a swing link having first and second ends, the swing link being pivotally connected at said first end to the front end of the seat support and coupled at said second end to the bases, and a connecting link having upper and lower ends, the connecting link being pivotally connected at said upper end to said rear end of the seat support and fixed at said lower end to the spring link at a location remote from said forward end of the spring link;

a seat attached to the seat structure; and a backrest attached to the spring link , whereby a rearward load applied to the backrest will bend the spring link to tilt both the seat and the backrest resulting in the tilting action.

13. A chair as claimed in claim 12 in which the spring link has a zone of reduced thickness to provide maximum flexibility in this zone.

14. A chair as claimed in claim 12 in which the spring link is non-metallic.

15. A chair having a tilting action , the chair including:

a base;

a support structure having a front element coupled to the base and extending forwardly and upwardly and having a distal end remote from the base;

a spring link fixedly coupled to the base and extending rearwardly to a rear end for bending to accommodate the tilting action;

a seat pivotally coupled to said distal end of the front element and coupled to the spring link at said rear end; and a backrest fixedly attached to said rear end of the spring link whereby a force applied to the backrest will bend the spring link and result in said tilting action.

16. A support structure as claimed in claim 15 in which the spring link has a zone of reduced thickness to provide maximum flexibility in this zone.

17. A support structure as claimed in claim 12 in which the spring link is non-metallic.

* * * * *